US007597937B2

(12) United States Patent
Anderson et al.

(10) Patent No.: US 7,597,937 B2
(45) Date of Patent: Oct. 6, 2009

(54) COATING APPARATUS FOR FLIMSY MEMBERS WITH ALIGNMENT MEANS

(75) Inventors: Jonathan D. Anderson, Chanhassen, MN (US); Scott D. Schmidt, Mound, MN (US)

(73) Assignee: Harland Medical Systems, LLC, Eden Prairie, MN (US)

( * ) Notice: Subject to any disclaimer, the term of this patent is extended or adjusted under 35 U.S.C. 154(b) by 40 days.

(21) Appl. No.: 11/726,375

(22) Filed: Mar. 21, 2007

(65) Prior Publication Data

US 2007/0222132 A1 Sep. 27, 2007

Related U.S. Application Data

(60) Provisional application No. 60/784,181, filed on Mar. 21, 2006, provisional application No. 60/784,173, filed on Mar. 21, 2006.

(51) Int. Cl.
*B05D 1/18* (2006.01)
*B05C 3/02* (2006.01)

(52) U.S. Cl. ..... 427/430.1; 427/2.1; 427/435; 118/400; 118/423; 118/428

(58) Field of Classification Search ..... 427/2.3, 427/2.28, 435; 118/423, 424, 429
See application file for complete search history.

(56) References Cited

U.S. PATENT DOCUMENTS 6,056,998 A 5/2000 Fujimoto
6,106,889 A 8/2000 Beavers et al.
6,254,921 B1 * 7/2001 Chappa et al. ..... 427/2.3
6,406,754 B2 6/2002 Chappa et al.
6,562,136 B1 5/2003 Chappa et al.
6,709,712 B2 3/2004 Chappa et al.
6,767,405 B2 7/2004 Eketorp et al.
6,860,946 B2 3/2005 Hossainy et al.
6,916,377 B2 7/2005 Bouchier et al.
2004/0161547 A1 8/2004 Carlson et al.
2004/0194704 A1 10/2004 Chappa et al.

OTHER PUBLICATIONS

PCX Series product video tour, Harland Medical Systems: Model PCX Coating Station [online], [retrieved on Nov. 19, 2008]. Retrieved from the Internet <URL: http://web.archive.org/web/20040402080949/harlandmedical.com/pcx.shtml>, Video, 3 minutes 42 second.*

PCX Coating Stations, Harland Medical Systems, pamphlet, 2004, 2 pages.*

* cited by examiner

*Primary Examiner*—Timothy H Meeks
*Assistant Examiner*—David Turocy
(74) *Attorney, Agent, or Firm*—Patterson, Thuente, Skaar & Christensen, P.A.

(57) ABSTRACT

A coating apparatus for batches of elongate flimsy members includes batch handling portion and a coating portion. The batch handling portion having an array support portion and an array alignment portion. The array support portion secures and vertically moves an array of elongate flimsy members to be lowered into an array of inlets of the coating portion, the inlets aligned in an array. The array alignment portion provides removable discrete position locating of the individual flimsy members by a guide portion that moves from an upwardly position downwardly to position each member of the array in alignment with the array of inlets. The support portion then lowers the flimsy members into the coating portion through the array.

9 Claims, 8 Drawing Sheets

Figure 1
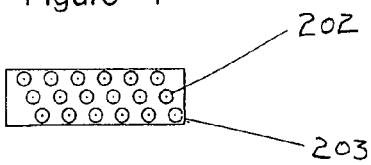
Figure 2
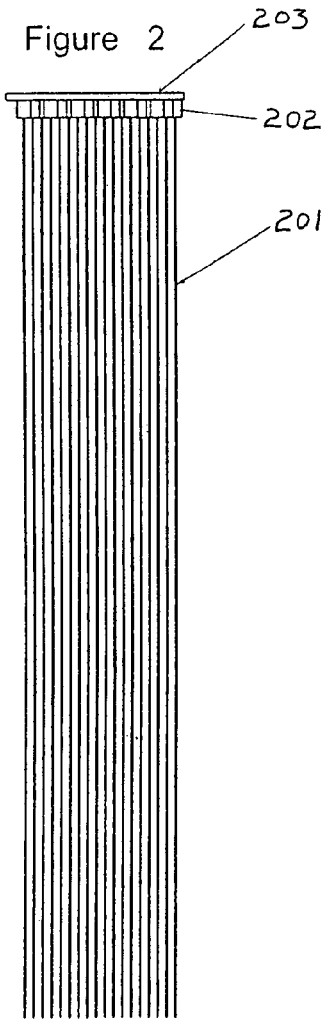
Figure 3
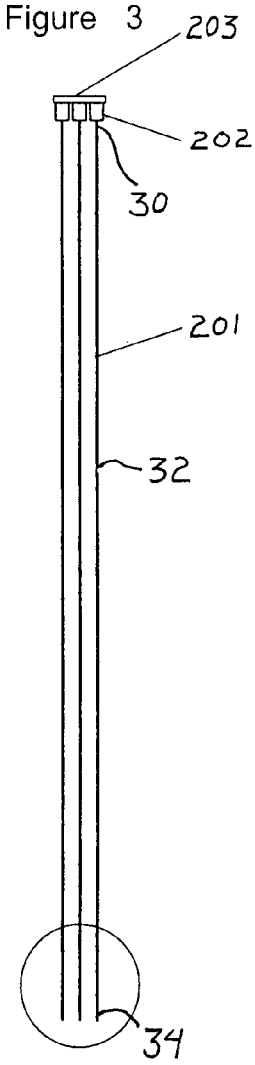
Figure 4
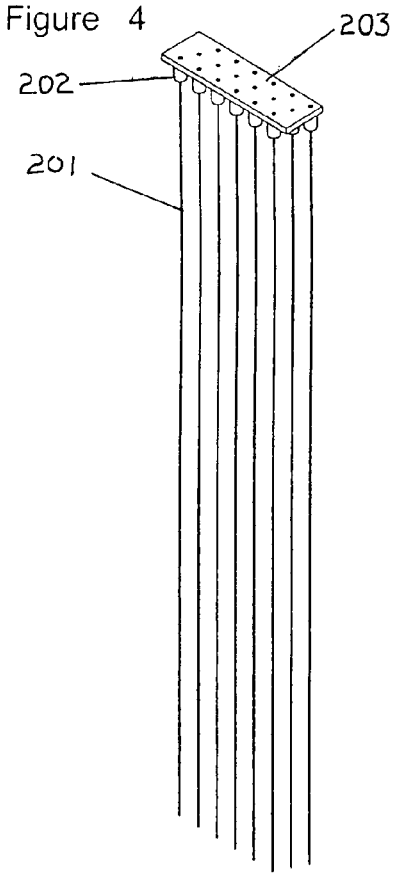
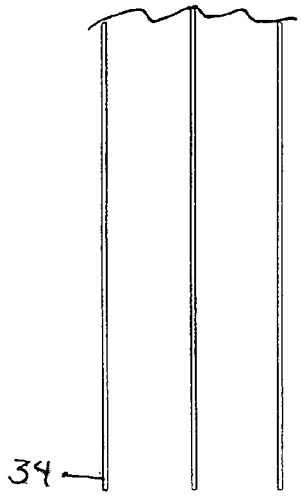
Figure 5

Figure 6
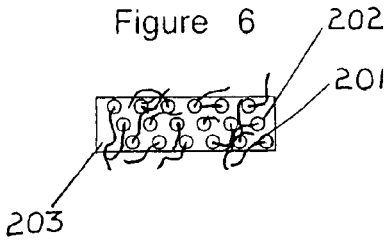
Figure 7
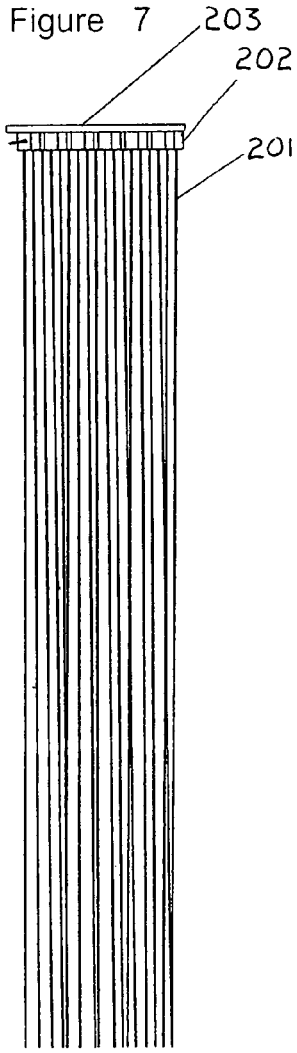
Figure 8
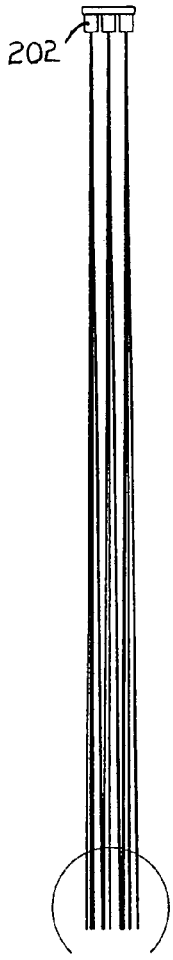
Figure 9
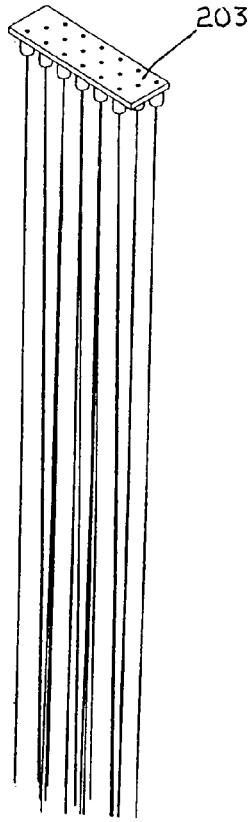
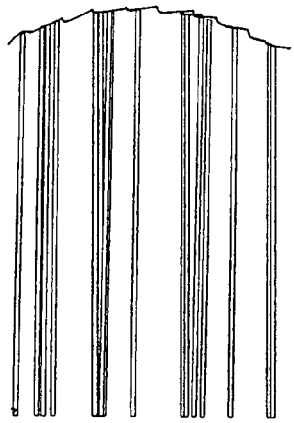
Figure 10

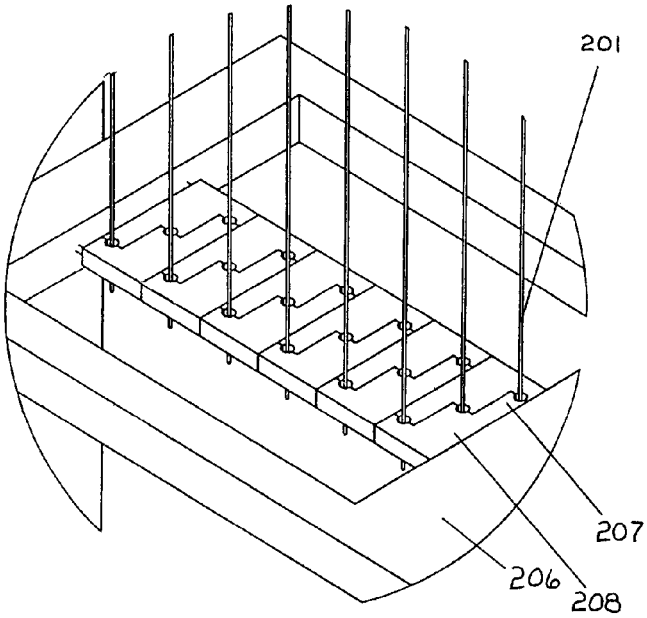
Figure 23
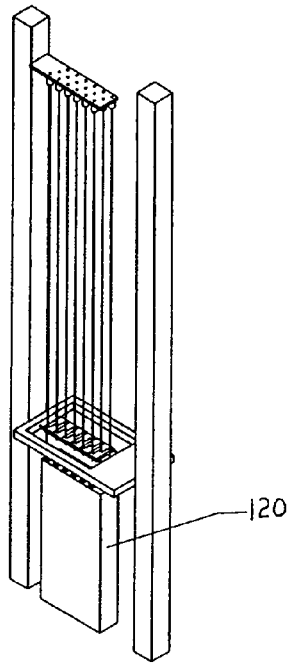
Figure 24
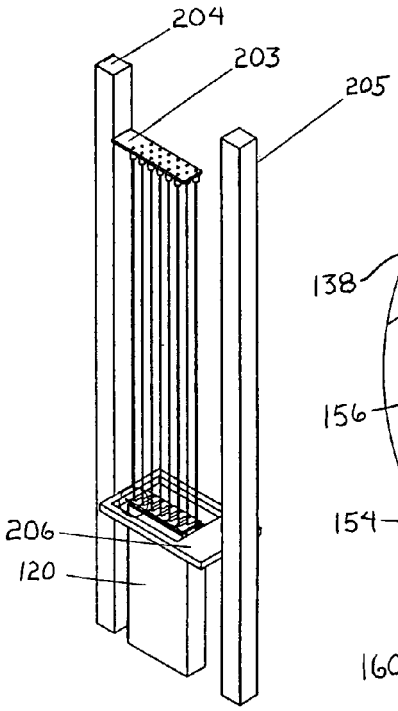
Figure #25
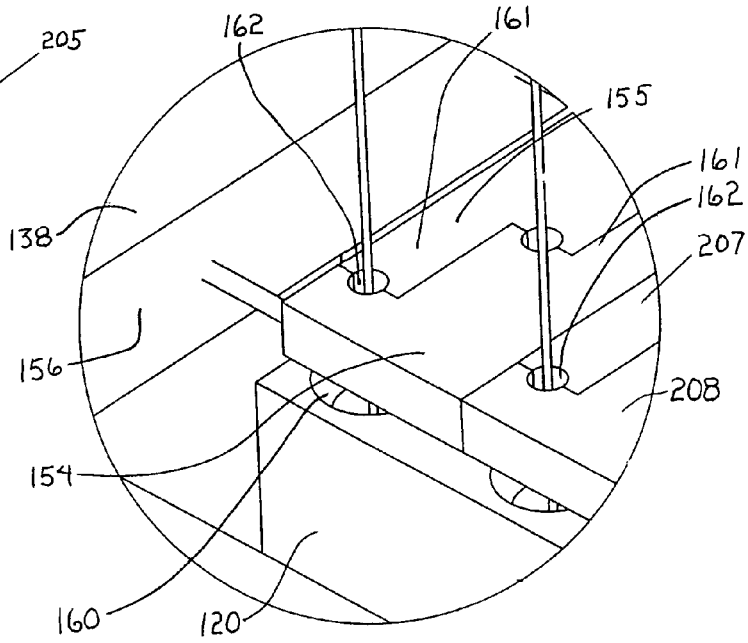
Figure 26

COATING APPARATUS FOR FLIMSY MEMBERS WITH ALIGNMENT MEANS

RELATED APPLICATION

This application claims priority to U.S. Provisional Application Ser. No. 60/784,181, filed Mar. 21, 2006 and U.S. Provisional Application Ser. No. 60/784,173, filed Mar. 21, 2006. Both of these applications are incorporated herein by reference.

FIELD OF THE INVENTION

This invention relates to coating systems, more particularly the invention relates to apparatus and processes for coating batches of elongate flimsy members.

BACKGROUND OF THE INVENTION

Various elongate flimsy members need to be handled by automated systems in the medical industry. These members are manufactured to become, for example, guide wires or catheters. These members are often up to 100 inches in length and may have a diameter of less than 0.030 inches in diameter. These members are generally flimsy to the extent that their weight is not able to pull them down with enough force to make them hang straight due to stress left in the materials from their manufacturing processes. A "flimsy" elongate member can, for example, be defined as a member that cannot resist a force of 0.1 pound applied upwardly to the bottom of the member. The flimsy member will buckle rather than resist the force.

These members are most conveniently processed by hanging vertically with the top end secured and the bottom end hanging loose. Generally these members will hang with curvatures that for a length greater than 20 inches may extend outwardly several inches. There may be no particular consistency in the hang pattern of one piece to the next. When more than one such elongate flimsy member is vertically hung adjacent to one another, intertwinement and entanglement may result. Although the individual members may be spaced sufficiently to avoid such intertwinement or entanglement, this equates to excessive space and volume requirements in the processing equipment. To reliably handle these devices in batch processing equipment and particularly automated equipment, a method and apparatus is needed to manage the tendency to intertwine and entangle and to position, control, and locate the ends of the elongate flimsy members. This is particularly needed for coating processes and equipment where the elongate flimsy members are inserted into funnel tubes for the coating.

SUMMARY OF THE INVENTION

A coating apparatus for batches of elongate flimsy members includes batch handling portion and a coating portion. The batch handling portion having a vertically movable carriage (in the z axis) with a securement portion attached thereto. The securement portion configured as a clamp mechanism for securing a vertically hung array of the elongate flimsy members. The batch handling portion also having an alignment portion including a vertically movable array guide portion, preferably configured as at least one comb. Each elongate flimsy member has a proximal end, an intermediate portion, and a distal end. The elongate flimsy members attached at proximal ends to the clamp mechanism and are lowerable into the coating portion by way of the carriage and clamping mechanism moving downward. The coating portion including a plurality of coating tubes with a plurality of inlets for discrete insertion of the distal ends of the array of elongate flimsy members into individual inlets. The inlets require positioning of the distal ends in the x and y axis for insertion into the inlets. The array alignment portion of the batch handling portion initially engages the array of elongate flimsy members by way of the guide portion proximate to the clamp mechanism and then moves down the array in the z axis direction to a position proximate the distal ends of the elongate flimsy members. The guide portion aligning the elongate flimsy members in the array as guide portion approaches the distal ends of the members such that when the guide portion is proximate the distal ends of the members, said ends are positioned to be in alignment with the inlets. Whereby the ends thus being located in alignment with the plurality of inlets may be inserted into the inlets by lowering of the array of the elongate flimsy members while the array guide portion maintains its lowered position. In preferred embodiments the array guide portion comprises a comb configuration with two opposing comb members that enter the array from different sides to define discrete member locating positions that correspond to the inlet positioning. In a preferred embodiment the comb members have comb fingers that may be rotated or moved laterally into an engagement position with the elongate flimsy members adjacent the plate. In preferred embodiments the comb portion or other configuration of the alignment portion may be retracted from the array before the elongate flimsy members are removed from the coating portion.

A feature and advantage of preferred embodiments of the invention is that the ends of a batch of elongate flimsy members are effectively and quickly positioned for insertion into a plurality of inlets for coating the members. The inlets may comprise funnels and the comb may guide the flimsy elongate members to align with the center of the funnels.

A feature and advantage of preferred embodiments of the invention is that close spacing of the elongate flimsy members in the array can now be accomplished permitting processing of a higher number of members in less space. A further advantage is that this minimizes the size of the coating machine.

Another feature and advantage of preferred embodiments of the invention is that contact with the alignment portion can be avoided by removal of the guide portion before the coated flimsy elongate members are withdrawn from the fluid, thereby preventing damage to the coatings on the members.

Another feature and advantage of preferred embodiments of the invention is that the entire length of the elongate flimsy members up to the attachment point, may be coated during the process.

BRIEF DESCRIPTION OF THE DRAWINGS

FIG. 1 is a bottom view of a securing plate for an array of elongate flimsy members.

FIG. 2 is an elevational view of an array of elongate flimsy members in an idealized straight hanging configuration.

FIG. 3 is an elevational view of an array of elongate flimsy members in an idealized straight hanging configuration.

FIG. 4 is a perspective view of an array of elongate flimsy members in an idealized straight hanging configuration.

FIG. 5 is a detail of the ends of an array illustrating idealized positioning needed for insertion into coating tubes.

FIG. 6 is a bottom view of a securing plate for an array of elongate flimsy members illustrating intertwinement.

FIG. 7 is an elevational view of the array of elongate flimsy members illustrating some intertwinement and disorganization of the distal ends.

FIG. 8 is an elevational view of the array of elongate flimsy members illustrating some intertwinement and disorganization of the distal ends.

FIG. 9 is an elevational view of the array of elongate flimsy members of FIG. 7.

FIG. 10 is a perspective view of the array of elongate flimsy members of FIG. 7.

FIG. 23 is a detailed perspective view of the circled portion of FIG. 22 with the comb in a lowered and inserted position.

FIG. 24 is a perspective view of the batch handling portion and coating portion with the comb in a lowered and inserted position and with the securing plate being lowered whereby the ends of the elongate flimsy members are being inserted into the inlets.

FIG. 25 is a perspective view of the batch handling portion and coating portion with the comb in a lowered and inserted position and with the securing plate being lowered whereby the ends of the elongate flimsy members are being lowered for insertion into the inlets.

FIG. 26 is a detailed perspective view of the circled portion of FIG. 25.

DETAILED DESCRIPTION OF PREFERRED EMBODIMENTS

Figure 1A:
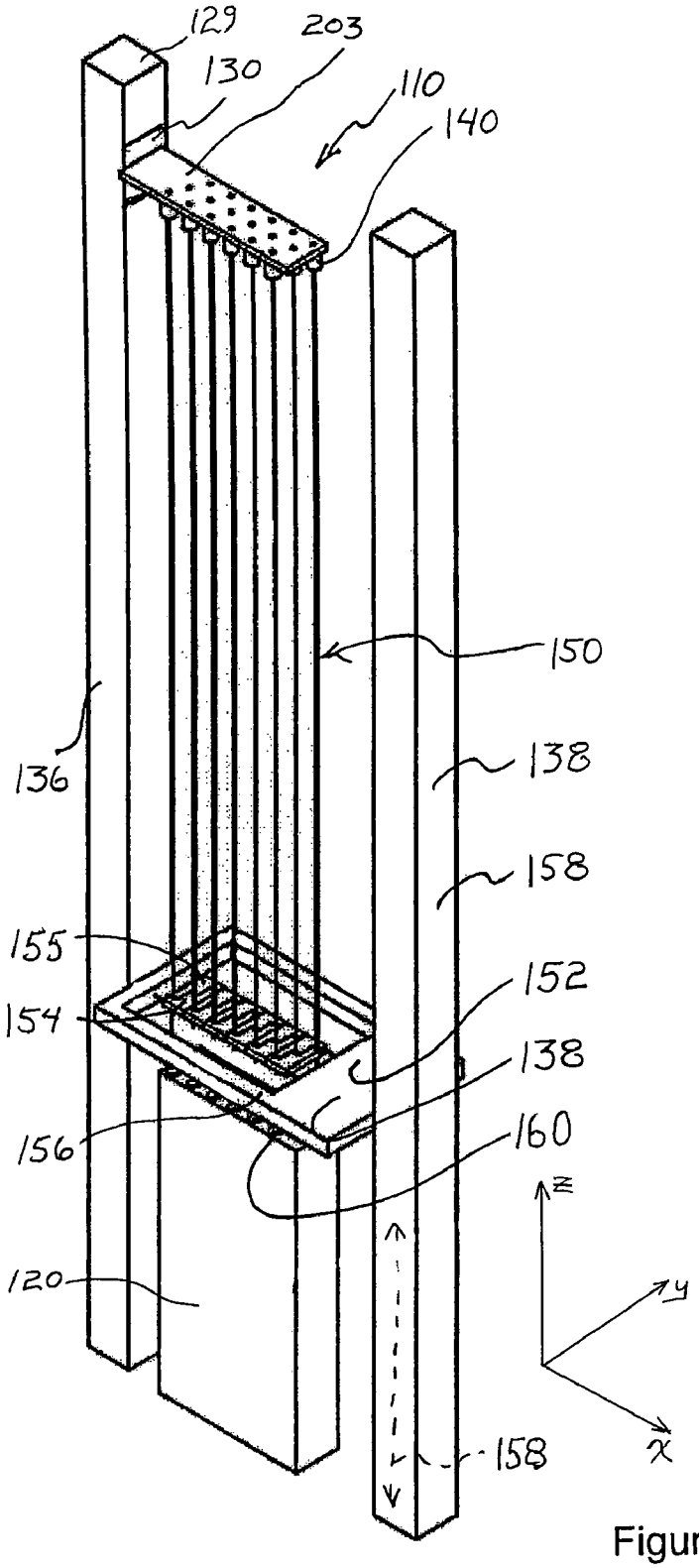
FIG. 1A is a perspective view of a coating apparatus according to the invention.
Figure 1B:
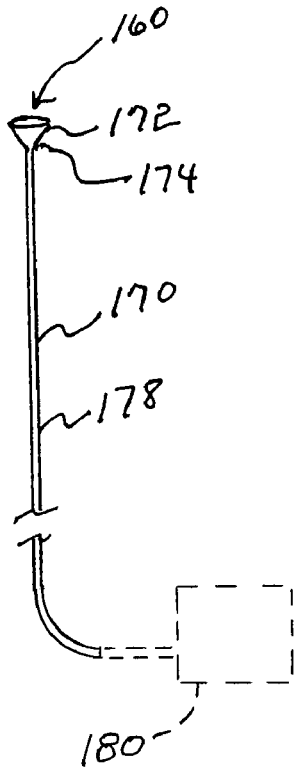
FIG. 1B is an elevational view of a coating tube suitable for the invention herein.
Figure 11:
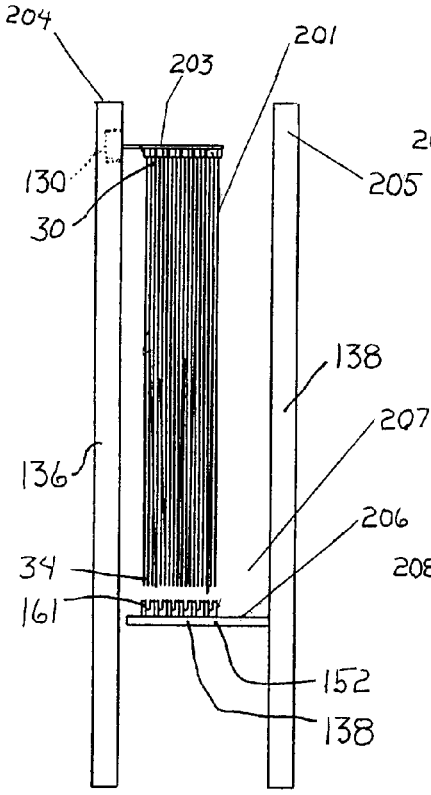
FIG. 11 is an elevational view of the batch handling portion with the comb in a lowered and retracted position.
Figure 12:
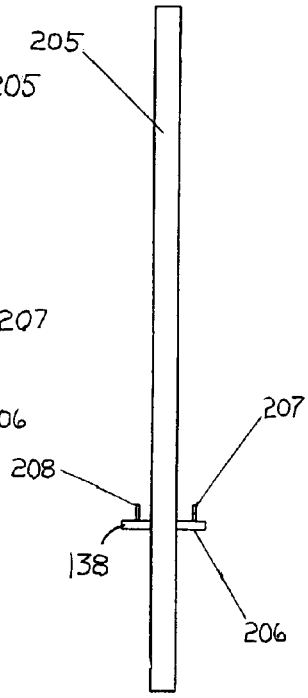
FIG. 12 is an end elevational view of the batch handling portion of FIG. 11.
Figure 13:
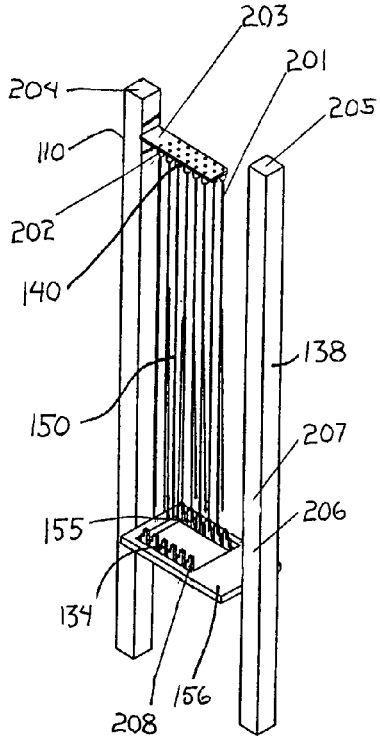
FIG. 13 is a perspective view of the batch handling portion of FIG. 11.

Referring to FIGS. 1A and 1B, a coating apparatus 100 for batches of elongate flimsy members includes batch handling portion 110 and a coating portion 120. The batch handling portion having an array support portion 129 and an array alignment portion 138. The array support portion having a vertically movable array support carriage (in the z axis) 130 associated with a vertical support and drive 136 for the carriage. The carriage has a plate 203 removably attached thereto or as part of the carriage, and has a plurality of clamp mechanisms 140 for securing a vertically hung array 150 of the elongate flimsy members. The array alignment portion 138 includes a guide portion 152, that preferably comprises a pair of comb members 154, 155, a guide support portion 156, and a vertical support and drive 158 for the alignment portion. The vertical support and drives for the alignment portion and carriage include suitable drive systems such as linear drives such as screw and nut systems, pneumatic actuators, chain drive systems or the like, known to those in the mechanical arts and not illustrated here.

The coating portion has a plurality of upwardly oriented inlet portions 160 of coating tubes 170, ideally configured as funnel tubes as illustrated in FIG. 1B. Each of such tubes has a funnel 172 at a first end 174, an opposite end 176, and an intermediate portion 178. Conventionally, such funnel tube may be manually filled and drained on a regular basis. Alternatively, each tube may be connected to a coating fluid supply 180. The fluid supply may appropriately have reservoirs, pumps, sensors, flow lines, and heating sources (not shown).

Referring to FIGS. 1-5, an array of flimsy elongate members 201 hang in an idealized straight position mounted into the securement portion 203 configured, for example, as a mechanical clamping mechanisms, for example collets 202, attached to a plate. Each flimsy elongate member has a first or proximal end 30, an intermediate portion, 32, and a second or distal end 34. The securement portion is preferably one of many providing for processing of batches and is interchangeably attachable to the carriage. Each securement portion 203 preferably has an array of holes for mounting the collets. In actual practice the elongate flimsy members do not by themselves maintain this illustrated position of FIGS. 1-5. This idealized aligned position is what is needed for proper insertion into the inlets of the coating portion.

FIGS. 6-10 illustrate a more actual hanging pattern of an array of flimsy elongate members 201. The members generally hang crooked and may be intertwined when suspended from collets 202. As illustrated, due to the lack of any alignment, it would not be possible to insert the ends 34 into the separate inlets 160. Note that the flimsy elongate members are much more ordered near the collets 202 and much less organized near the bottom of the device.

FIGS. 11-13, and 26 illustrate the batch handling portion 110 with the array alignment portion 138. The vertical support and drive 136 comprise a z axis system 204 and move the plate 203 with all the hanging flimsy elongate members up and down with a controlled motion profile. The vertical support and drive 158 for the alignment portion comprise another z axis system 205 that can move guide support portion 206 up and down in a controlled motion profile. Guide support portion 206 is a structure supporting the first and second comb members 207, 208. Comb members have fingers 161 that rotate inward and move in the y axis to laterally constrain the flimsy members, in the x and y axis directions, by forming discrete flimsy member locating positions 162. Note the item guide support portion 206 may starts out below the end of the flimsy elongate members. The comb members may rotate into and out of position and/or laterally move into and out of position. At the start of the process the comb members fingers 161 are rotated up and move as far apart as they can.

Figure 14:
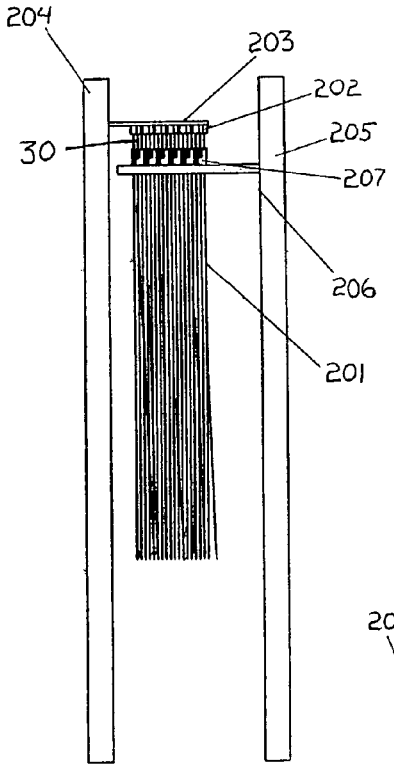
FIG. 14 is an elevational view of the batch handling portion with the comb in a raised and retracted position.
Figure 16:
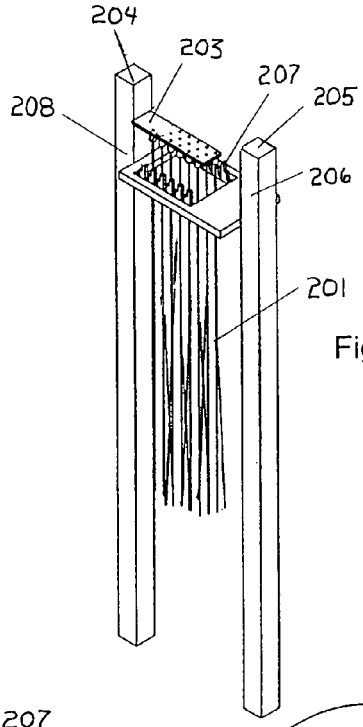
FIG. 16 is a perspective view of the batch handling portion of FIG. 14.
Figure 15:
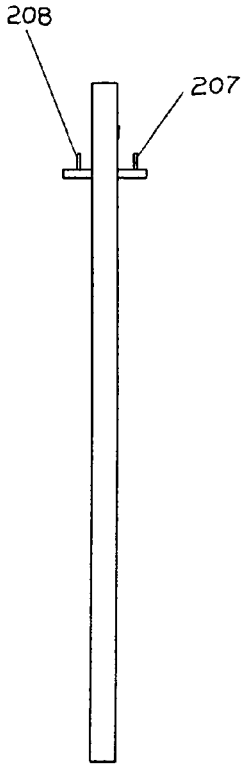
FIG. 15 is an end elevational view of the batch handling portion of FIG. 14.

FIGS. 14-16 show different views of the system for controlling the ends of flimsy elongate members at the next step in the process. The primary difference between FIGS. 14-16 and FIGS. 11-13 is that the Z axis 205 has moved the guide support portion 206 with the comb members 207, 208 up near the proximal ends of the flimsy elongate members. Because the flimsy deices have a much more defined position near the collets holding them, the comb system starts up near the collets.

Figure 18:
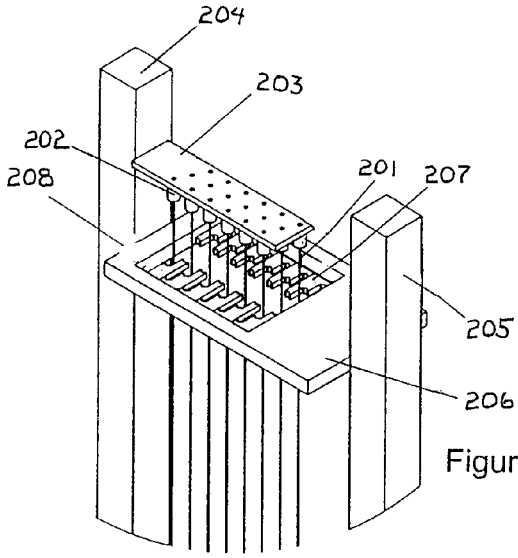
FIG. 18 is a detailed perspective view of the circled portion of FIG. 17.
Figure 17:
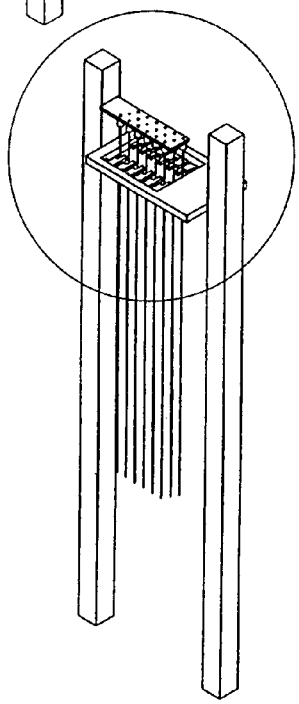
FIG. 17 is a perspective view of the batch handling portion with the comb in a raised and preinsertion position.

FIGS. 17-18 show the next process step. That is to rotate comb members 207 and 208 into a position parallel to each other. FIG. 18 shows a blown up view of the circular section of FIG. 18.

Figure 19:
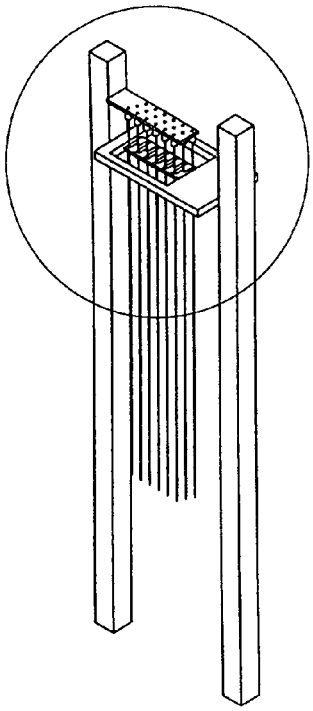
FIG. 19 is a perspective view of the batch handling portion with the comb in a raised and inserted position.
Figure 20:
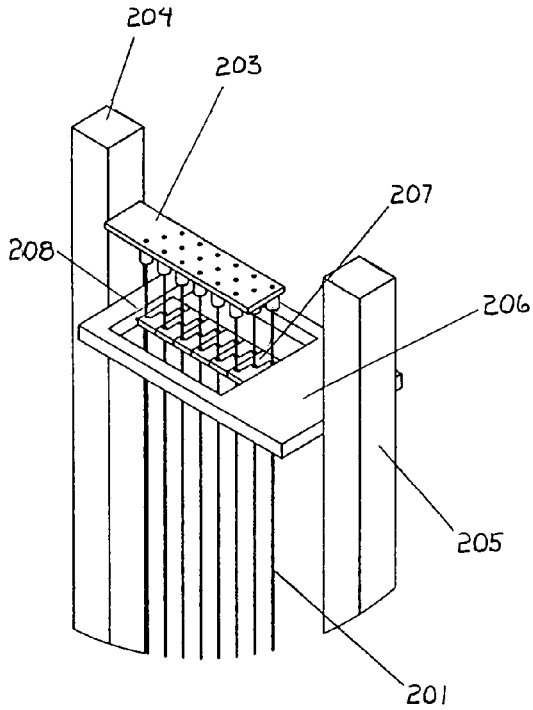
FIG. 20 is a detailed perspective view of the circled portion of FIG. 19.

FIGS. 19-20 show the next process step. That is to translate combs 207 and 208 into a position so that they are touching each other and they now capture and laterally constrain each of the elongate flimsy members. FIG. 20 shows a blown up view of the circular enclosed portion of FIG. 19. Each comb member has a shape machined into the end of it to help guide the flimsy elongate member into the discrete flimsy member locating positions to be captured within the combs. Now that the combs 207 and 208 are closed each flimsy elongate members is contained into the discrete member locating positions aligned with the inlets of the funnel tubes.

Figure 21:
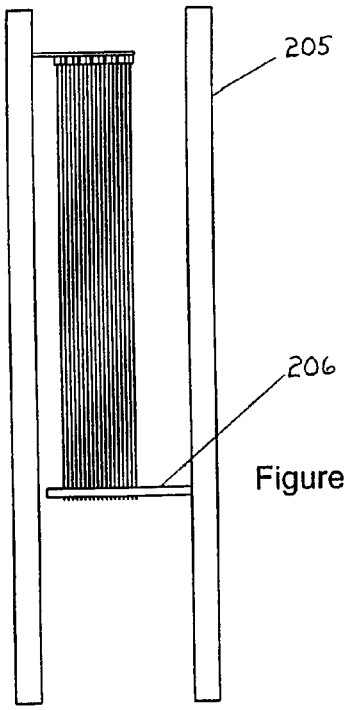
FIG. 21 is an elevational view of the batch handling portion with the comb in a lowered and inserted position.
Figure 22:
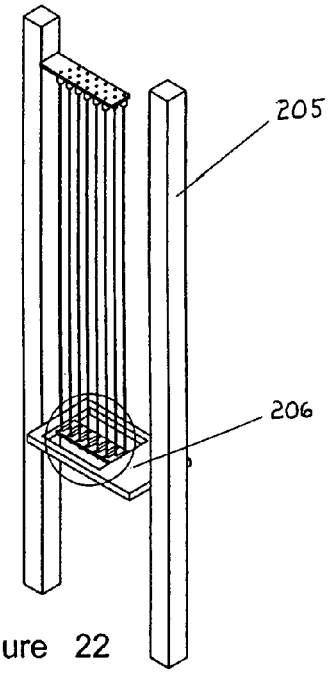
FIG. 22 is a perspective view of the batch handling portion with the comb in a lowered and inserted position.

FIGS. 21-23 show the next process step. That is to move the combs mounted to item 206 down until they are near the ends of the flimsy elongate member. Now the end of each device is positioned to the discrete flimsy member locating position. FIG. 21 is a right view. FIG. 22 is an isometric view. FIG. 23 shows a blown up view of circular section of FIG. 22 to show how the end of each flimsy elongate member is contained into a know area of uncertainty.

FIG. 24-26 illustrate the next step in the process which includes the coating portion 120. The plate 203 and guide portion 206 are lowered at the same rate until the ends of the flimsy elongate members are just started into the array of funnel tubes. FIG. 26 shows how the discrete flimsy member locating position when applied to the end of each flimsy elongate member is smaller than the area of the inlets 160 of each process chamber (funnel tube). Now each flimsy elongate member is started into its process chamber.

Figure 27:
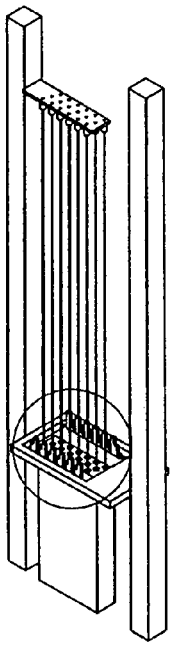
FIG. 27 is perspective view of the batch handling portion and coating portion with the comb in a lowered and retracted.
Figure 28:
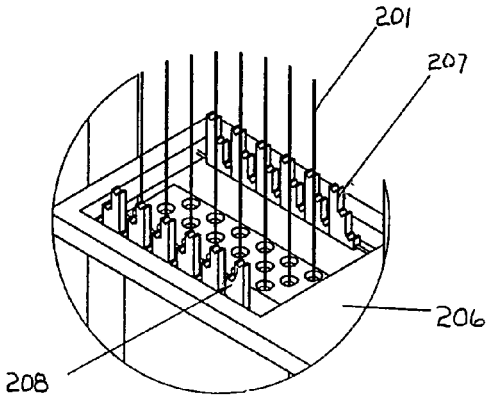
FIG. 28 is a detailed perspective view of the circled portion of FIG. 27.

FIGS. 27-28 show the next step in the process. Once the flimsy elongate members are started into the process chambers the comb members 207 and 208 can be retracted and rotated up. This leaves the process area clear from any obstructions so the flimsy elongate members can be fully inserted into the process chamber. Alternatively, in some embodiments, the comb members 207, 208 can remain in place as shown in FIG. 26.

Figure 29:
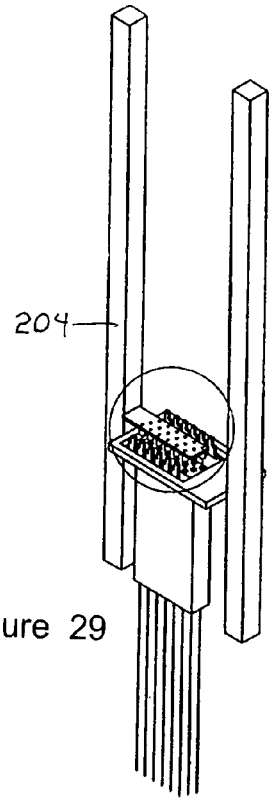
FIG. 29 is a perspective view of the batch handling portion and coating portion with the securing plate has been lowered thereby inserting the flimsy elongate members fully into the funnel tubes.
Figure 30:
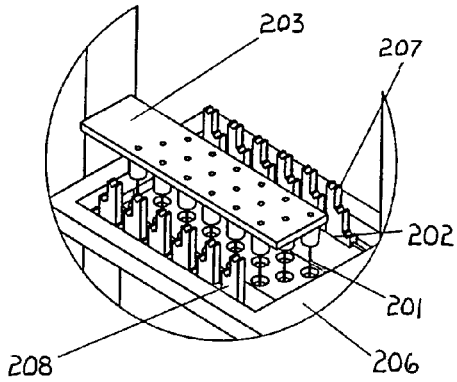
FIG. 30 is a detailed perspective view of the circled portion of FIG. 29.

FIGS. 29-30 show the next step in the process. The Z axis of the flimsy elongate members now slowly goes down until each flimsy elongate member is inserted into its process chamber. The motion profile of this axis is programmable so that rate at which item 203 is lowered is highly controlled. If the rate of decent is too large, the flimsy elongate members might bend and lay on top of the process chamber instead of being inserted into it.

The number and pattern of funnel tubes used in the reservoir may vary greatly to maximize throughput.

The control of the apparatus and its operable portions may be accomplished by known computer controlled devices (pc, PLC, motion card, amplifier, power supply, servo motor, stepper, etc.) and the actual motion can be made by many types of drive systems (belt drive, ball screw, linear motor, etc.).

The motion of the combs is described as a rotation and then a translation to get the combs to contain the flimsy elongate members. This motion could be done in many ways rotate while translating, translate then rotate, etc. It could also be done with either a pure translation or a pure rotation. Moreover, combs could be inserted from adjacent sides rather than opposite sides to define the discrete flimsy member locating positions. The arrangement of the flimsy elongate members should take many forms of an array pattern. The pattern does not have to be symmetrical or linear.

The distance from the guide portion to the collets can vary depending on how flimsy the device is. Many shorter devices that hang straight can be contained with a comb that never has to be raised to a position proximate the collets. Also, in certain embodiments, the guide portion can be a component that is paired with a securement portion when the elongate flimsy members are attached to the securement portion. That is, the flimsy members can be inserted through apertures on the guide portion during clamping and assembly as a batch. This allows the guide portion to be a single piece that may stay with the batch during processing.

The above embodiments are intended to be illustrative and not limiting. Additional embodiments are within the claims. Although the present invention has been described with reference to particular embodiments, workers skilled in the art will recognize that changes may be made in form in detail with departing from the spirit and scope of the invention.

We claim:

1. A method of coating a plurality of elongate members utilizing an apparatus having a batch handling portion, a coating portion, and an alignment portion, the batch handling portion having a plurality of flimsy member securement portions with an array of elongate flexible members dangling from each flimsy member securement portion, each array having a distal ends in a state of disorganization, the method comprising the steps of:

engaging each array with the alignment portion adjacent the flimsy member securement portion before the elongate members are coated, moving the alignment portion down the array toward the distal ends whereby the distal ends are taken out of the state of disorganization and are put into an aligned state.

2. A method of sequentially coating a plurality of batches of elongate flimsy members, each batch comprising an array of elongate flimsy members secured to a separate flimsy member securement portion, each flimsy member having an attached end and a dangling end, the method comprising the steps of:

a) attaching a batch to a batch handling portion whereby the dangling ends of the elongate flimsy members are in an unorganized arrangement, b) positioning a guide portion proximate the flimsy member securement portion in an open configuration, then laterally moving the guide portion to a closed position to simultaneously individually engage the flimsy members at a location where the flimsy members are in an organized configuration to discretely position each elongate flimsy member of the batch, c) lowering the guide portion along the array of flimsy members whereby the dangling ends of the elongate flimsy members are brought from a disorganized arrangement into an organized arrangement, d) inserting the array of elongate flimsy members into a coating portion, e) removing the array from the coating portion and conveying the batch from the batch handling portion, f) repeating the above steps sequentially with additional batches of elongate flimsy members.

3. The method of claim 2 whereby the step b occurs after step a and step b comprises insertion of the guide portion laterally into the array of flimsy members.

4. The method of claim 3 wherein the guide portion comprises opposing cooperating members and the insertion of the guide portion occurs from opposing sides of the array of flimsy members.

5. A method of coating a batch of elongate flimsy members, the batch comprising a plurality of elongate flimsy members, each having a proximal end, an intermediate portion, and a distal end, the method comprising the steps of:

securing each of the elongate flimsy members at the proximal end of each flimsy member in an array such that the distal ends of the elongate flimsy members are dangling downward in an unaligned disorganized manner;

securing the array to a vertically movable carnage whereby the array may be moved collectively downward;

positioning an array alignment portion to the batch proximate the carriage in an open configuration nearer to the proximal ends of the elongate flimsy members than the distal ends of the members;

moving the array alignment portion into a closed configuration to simultaneously individually engage each of the elongage flimsy members with the array alignment portion at a location where the elongate flimsy members are in an organized configuration such that each of the members is positionally constrained therein;

lowering the array alignment portion downwardly with respect to the batch whereby the distal ends of the elongate flimsy members are aligned and positioned from a disorganized configuration into an organized configuration for insertion into inlets.

6. The method of claim 5 further comprising the step of lowering the batch downwardly with the distal ends aligned such that the distal ends are inserted into the inlets and the elongate flimsy members are coated.

7. The method of claim 6 further comprising the step of moving the array alignment portion to a non-constraining position before the elongate flimsy members are coated.

8. The method of claim 5 wherein the array alignment portion comprises a comb member and the method further comprises the step of moving the comb member from a non-constraining position to a constraining position before lowering the array alignment portion, the constraining position where each of the elongate flimsy members is positionally constrained therein.

9. A method of coating an array of elongate flimsy members, the array comprising a plurality of elongate flimsy members, each elongate flimsy member having a proximal end, an intermediate portion, and a distal end, the distal ends of the array being in a disorganized state, the method comprising the steps of:

supporting the array on a support in a batch handling portion whereby the elongate flimsy members are dangling downwardly with the distal ends unaligned, moving an array guide portion from proximate the support downwardly with respect to the array whereby the distal ends of the elongate flimsy members are put into alignment with an array of inlets of a coating portion, and lowering the array of elongate flimsy members into the coating portion, wherein the array guide portion comprises a plurality of comb members and the method further comprising the step of moving the plurality of comb members from a non-alignment position to an alignment position before lowering the array guide portion from proximate the support downwardly and wherein the method further comprises the step of moving the plurality of comb members by rotating said comb members about a plurality of horizontal axes.

* * * * *